US010488052B2

(12) United States Patent
Kalyanaraman et al.

(10) Patent No.: US 10,488,052 B2
(45) Date of Patent: Nov. 26, 2019

(54) OUTDOOR GAS FIRED PATIO HEATER

(71) Applicant: Radianz Energy Private Limited, Tamilnadu (IN)

(72) Inventors: Seetharaman Kalyanaraman, Tamilnadu (IN); Skandakumar Krishnasamy, Tamilnadu (IN)

(73) Assignee: Radianz Energy Private Limited, Tamilnadu (IN)

( * ) Notice: Subject to any disclaimer, the term of this patent is extended or adjusted under 35 U.S.C. 154(b) by 0 days.

(21) Appl. No.: 15/287,053

(22) Filed: Oct. 6, 2016

(65) Prior Publication Data

US 2017/0102150 A1 Apr. 13, 2017

(30) Foreign Application Priority Data

Oct. 7, 2015 (IN) ..... 5360/CHE/2015

(51) Int. Cl.

| | |
|---|---|
| ***F24C 3/00*** | (2006.01) |
| ***F24C 3/10*** | (2006.01) |
| ***F24C 3/04*** | (2006.01) |
| *F24C 1/12* | (2006.01) |
| *F24C 15/22* | (2006.01) |

(52) U.S. Cl.

CPC ..... *F24C 3/103* (2013.01); *F24C 3/04* (2013.01); *F24C 1/12* (2013.01); *F24C 3/00* (2013.01); *F24C 15/22* (2013.01)

(58) Field of Classification Search

CPC ..... F24C 1/12; F24C 3/00; F24C 3/10; F24C 3/04; F24C 15/22

USPC ..... 431/255, 5; 126/92 AC, 92 B

See application file for complete search history.

(56) References Cited

U.S. PATENT DOCUMENTS

| | | | | |
|---|---|---|---|---|
| 2,985,137 | A * | 5/1961 | Horne | A01K 31/19 119/307 |
| 6,422,232 | B1 * | 7/2002 | Ashton | F21H 1/00 126/92 B |
| 6,470,877 | B1 * | 10/2002 | Waters | F24C 1/12 126/92 AC |
| 7,086,396 | B2 * | 8/2006 | Waters | F24C 1/12 126/92 AC |
| 7,278,418 | B2 * | 10/2007 | Duphily | F23D 14/12 126/92 AC |
| 8,176,910 | B2 * | 5/2012 | O'Connell | F24C 1/10 126/92 AC |
| 9,328,927 | B2 * | 5/2016 | Wang | F24C 1/12 |
| 10,015,655 | B2 * | 7/2018 | Doorandish | F24C 1/12 |
| 2008/0006263 | A1 * | 1/2008 | Seichei | F24F 3/14 126/92 R |

(Continued)

*Primary Examiner* — Gregory L Huson
*Assistant Examiner* — Nikhil Mashruwala
(74) *Attorney, Agent, or Firm* — J. Peter Paredes; Rosenbaum IP, P.C.

(57) ABSTRACT

The present invention comprises an assembly patio heater (PH) base at the bottom, a gas combination valve, a reducing bushing unit, a PH perforated cylinder, a tubing unit along with the pilot assembly, PH pan head, a gas combination control assembly, a gas lighter unit, a burner assembly and an assembly PH emitter grid assembly. A reflector is mounted at the top of the assembly PH emitter grid assembly. The present invention provides an automatic ignition system along with ON/OFF switch and the device also has an inbuilt transformer which provides the safety to the user(s). Hence, the present invention is very easy to operate and user friendly.

7 Claims, 8 Drawing Sheets

(56) References Cited

U.S. PATENT DOCUMENTS

| | | | | |
|---|---|---|---|---|
| 2009/0223512 | A1* | 9/2009 | Konkle | F24C 1/10<br>126/92 AC |
| 2015/0354817 | A1* | 12/2015 | Fuller | F24H 9/0068<br>126/75 |
| 2016/0348915 | A1* | 12/2016 | Yang | F24C 1/12 |

* cited by examiner

OUTDOOR GAS FIRED PATIO HEATER

TECHNICAL FIELD OF THE INVENTION

The present invention relates generally to an outdoor gas fired patio heater. More particularly, the invention provides a gas fired heater that uses natural gas as a source of fuel.

BACKGROUND OF THE INVENTION

A patio heater is a device for generating radiant heat for indoor and outdoor use. The patio heater uses a Liquid Petroleum Gas (LPG) or natural gas as the source of fuel and the heat is radiated from the device in a circular pattern which spreads around the environment.

Today, most of the patio heaters radiate infrared energy to heat the indoor and outdoor areas. The basic principle used in such device is 'Heat Transfer through Radiation'. Every material, when heated to a specific temperature, produces heat in the form of electromagnetic waves in the infrared range. Sun is an excellent example of an infrared patio heater. The rays emitted by sun keep travelling through space and heat is emitted only when the rays strike any solid object. Here, the rays in the space strike the earth and heat is produced. Hence, infrared patio heaters do not heat the air, but instead heat the solid objects such as furniture, floor, objects, and people directly.

Various types of conventional patio heaters are known in the prior art, wherein most of them use manual operation to switch ON or OFF the heater. The user has to operate the heater manually every time in order to switch ON or OFF the heater, which is a tedious work to the user and also there is no safety involved with respect to the user. This may cause burns to the skin of the user while igniting the heater, which is a threat to safety.

Further, in the existing electric patio heaters, a transformer is installed outside the heater, which leads to the necessity of an external connection to switch ON the heater. This becomes a difficult task when the heater is used for outdoor purpose as it is difficult to provide the external source to operate the heater.

Hence, looking at the problems in the prior art, there is a need of a patio heater with an automatic ignition system along with ON/OFF switch and inbuilt transformer. The device should also provide safety to the user.

SUMMARY OF THE INVENTION

The present invention overcomes the drawbacks of the technology models available in the state of the art by providing an outdoor gas fired patio heater, wherein the patio heater includes an automatic ignition system along with ON/OFF switch and has an inbuilt transformer which provides the safety to the user (s). The outdoor gas fired patio heater comprises an assembly patio heater (PH) base at the bottom of the heater and a gas combination valve fixed on the top of the assembly PH base. A reducing bushing unit is fitted along with the gas combination valve. A PH perforated cylinder is mounted on the assembly PH base which encloses the entire assembly.

A tubing unit along with the pilot assembly is fixed inside the PH perforated cylinder. The tubing unit and pilot assembly are coupled with a pilot frame. A PH pan head is placed on the top of the PH perforated cylinder. A gas combination valve is fitted in the PH perforated cylinder.

An enclose box is fitted on the other side of the perforated cylinder wall. The enclose box comprises an ON/OFF switch, a gas lighter unit and a transformer. A burner assembly is fixed on the top of the PH perforated cylinder, wherein the burner assembly is connected to the gas combination valve inside the PH perforated cylinder. An assembly PH emitter grid assembly is fitted upon the PH pan head, which encloses the burner assembly. A reflector is mounted at the top of assembly PH emitter grid assembly.

In a preferred embodiment of the invention, the reflector is dome shaped or mushroom shaped.

In a preferred embodiment of the invention, the patio heater has an inbuilt transformer that eliminates the need of external connections.

In a preferred embodiment of the invention, the gas lighter unit is ignited when the heater is powered ON, wherein the automatic spark is generated to ignite the heater within the predefined time.

In a preferred embodiment of the invention, the heater regenerates the spark for the predefined number of times with the interval of predefined time between each spark during interruption of the gas supply, thereby the heater restarts automatically.

In a preferred embodiment of the invention, the heater is switched OFF and restarted after certain period of time if the device fails to get ignited after automatic sparking for predefined number of times.

The present invention provides an automatic ignition system to ignite the heater. Hence, the present invention is very easy to operate and user friendly. An inbuilt transformer is equipped within the heater, therefore need of an external connection is eliminated. The present invention is a plug and play unit ensuring the high standard safety measures. The present invention provides a system and method which is simple, time saving, resource efficient, and cost effective.

The invention may be used in variety of outdoor applications such as restaurant patios, the rooftop decks, transit Shelters, public spaces etc.

It is to be understood that both the foregoing general description and the following details description are exemplary and explanatory and are intended to provide further explanation of the invention as claimed.

BRIEF DESCRIPTION OF THE DRAWINGS

The foregoing and other features of embodiments will become more apparent from the following detailed description of embodiments when read in conjunction with the accompanying drawings. In the drawings, like reference numerals refer to like elements.

DETAILED DESCRIPTION OF THE INVENTION

Reference will now be made in detail to the description of the present subject matter, one or more examples of which are shown in figures. Each embodiment is provided to explain the subject matter and not a limitation. These embodiments are described in sufficient detail to enable a person skilled in the art to practice the invention, and it is to be understood that other embodiments may be utilized and that logical, physical, and other changes may be made within the scope of the embodiments. The following detailed description is, therefore, not be taken as limiting the scope of the invention, but instead the invention is to be defined by the appended claims.

The term 'PH' as claimed in embodiment defines the Patio Heater.

The present invention overcomes the drawbacks of the technology models available in the state of the art by providing an outdoor gas fired patio heater, wherein the patio heater includes an automatic ignition system along with ON/OFF switch and has an inbuilt transformer which provides the safety to the user (s). The outdoor gas fired patio heater comprises an assembly PH base at the bottom of the heater and a gas combination valve fixed on the top of the assembly PH base. A reducing bushing unit is fitted along with the gas combination valve. A PH perforated cylinder is mounted on the assembly PH base which encloses the entire assembly. A tubing unit along with the pilot assembly is fixed inside the PH perforated cylinder. The tubing unit and pilot assembly are coupled with a pilot frame. A PH pan head is placed on the top of the PH perforated cylinder. The bottom of the PH pan head is provided with ventilation openings to ensure the flow of combustion air. A gas combination valve is fitted in the PH perforated cylinder. An enclose box is fitted on the other side of the perforated cylinder wall. The enclose box comprises an ON/OFF switch, a gas lighter unit and a transformer. A burner assembly is fixed on the top of the PH perforated cylinder, wherein the burner assembly is connected to the gas combination valve inside the PH perforated cylinder. An assembly PH emitter grid assembly is fitted upon the PH pan head, which encloses the burner assembly. A reflector is mounted at the top of assembly PH emitter grid assembly.

In the present invention an automatic ignition system is used to ignite the heater. Hence, the present invention is very easy to operate and user friendly. An inbuilt transformer is equipped in the present invention; therefore need of an external connection is eliminated. The present invention is a plug and play unit ensuring the high standard safety measures.

Figure 1:
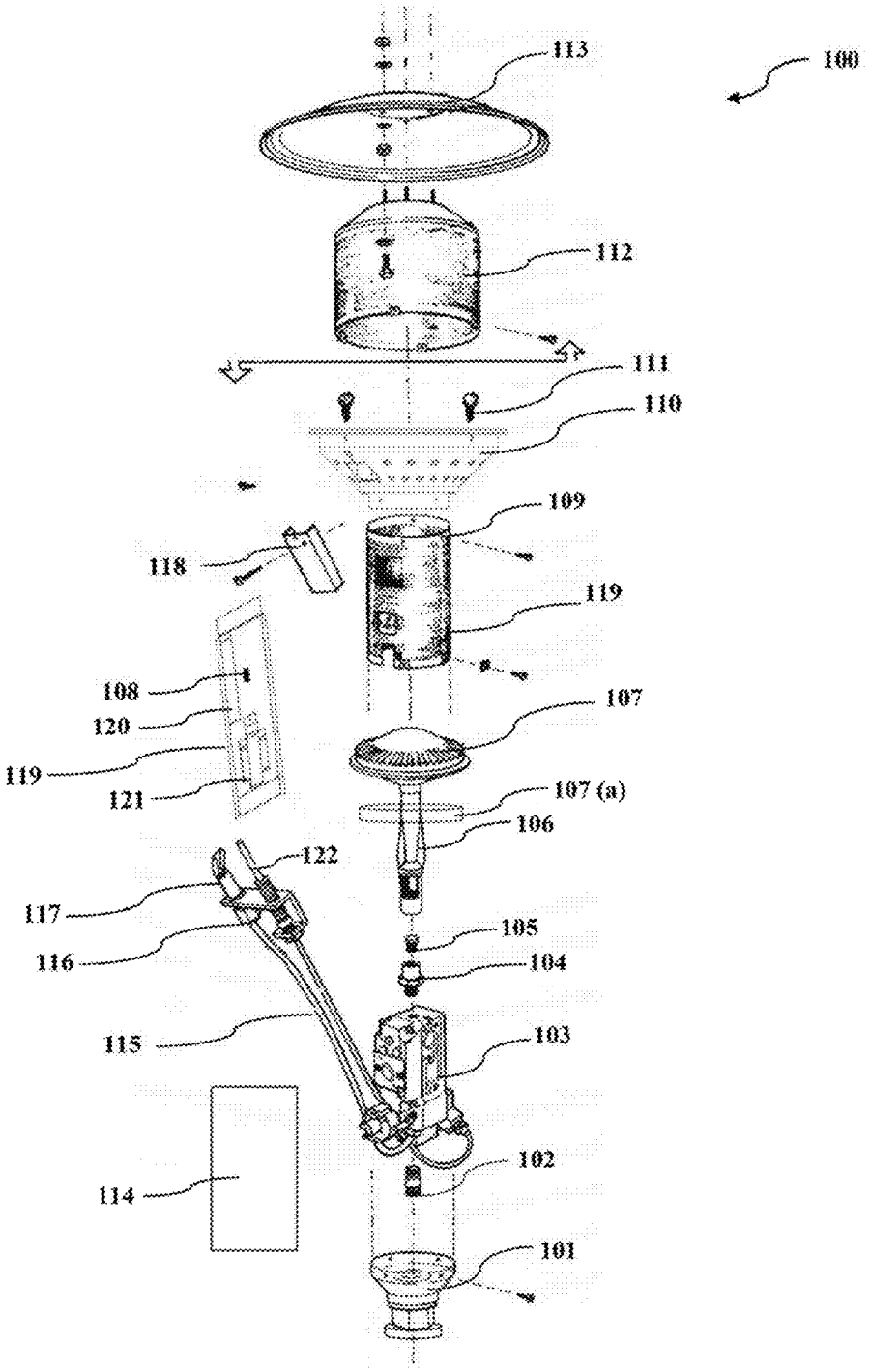
FIG. 1 illustrates an exploded view of the outdoor gas fired patio heater, in accordance to one or more embodiments of the invention.

FIG. 1 illustrates an exploded view of the outdoor gas fired patio heater, in accordance with an embodiment of the invention. The outdoor gas fired patio heater comprises an assembly PH base 101 at the bottom of the heater and a gas combination valve 103 fixed on the top of the assembly PH base 101. A reducing bushing unit 102 is fitted along with the gas combination valve 103. A PH perforated cylinder 109 is mounted on the assembly PH base 101 which encloses the entire assembly. A tubing unit 115 along with the pilot assembly 116 is fixed inside the PH perforated cylinder 109. The tubing unit 115 and pilot assembly 116 are coupled with a pilot frame 117. A PH pan head 110 is placed on the top of the PH perforated cylinder 109, wherein the bottom of the PH pan head 110 has ventilation openings to ensure the free flow of combustion air. A gas combination valve 103 is fitted inside the PH perforated cylinder 109, wherein the gas combination valve 103 is covered with a channel.

An enclose box 119 is fitted on the other side of the perforated cylinder wall. The enclose box 119 comprises an ON/OFF switch 108, a gas lighter unit 120 and a transformer 121. The gas lighter unit 120 comprises of a printed circuit board (PCB) control and a wire assembly which is covered with a channel.

A burner assembly 107 is fixed on the top of the PH perforated cylinder 109, wherein the burner assembly 107 is connected to the gas combination valve 103 inside the PH perforated cylinder 109 through a burner tube 106, an orifice 105 and an adapter 104 inside the PH perforated cylinder 109, wherein the burner tube 106, orifice 105 and the adapter 104 are connected in series as shown in FIG. 1.

An assembly PH emitter grid assembly 112 is fitted upon the PH pan head 110, which encloses the burner assembly 107. A reflector 113 is mounted at the top of the assembly PH emitter grid assembly 112, wherein the reflector 113 is a dome shaped or mushroom shaped. The dome shaped or mushroom shaped design of the reflector 113 ensures the radiated heat to circulate uniformly into a circular space around the heater. The name plate 114 is mounted on the outer wall of the enclose box 119.

In the preferred embodiment of the present invention, the device has an inbuilt transformer 121 that eliminates the need of external connections.

In the preferred embodiment of the present invention, the heater is powered ON and the gas lighter 120 unit starts working. The gas combination valve 103 in the gas combination assembly is opened, wherein the natural gas is allowed to flow in the gas combination valve 103. The automatic spark is generated to ignite the heater within the predefined time and the whole burner starts igniting. Further, if the gas supply is stopped due to any reason then the spark is regenerated again for the predefined number of times with the interval of predefined time between each spark. This restarts the heater automatically without any manual operation.

In the preferred embodiment of the present invention, if the burner does not get ignited even after automatic sparking for predefined number of times, the circuit is allowed to switch OFF along with the gas combination valve 103. The device is powered ON again after a predefined period of time.

Figures 2A, 2B:
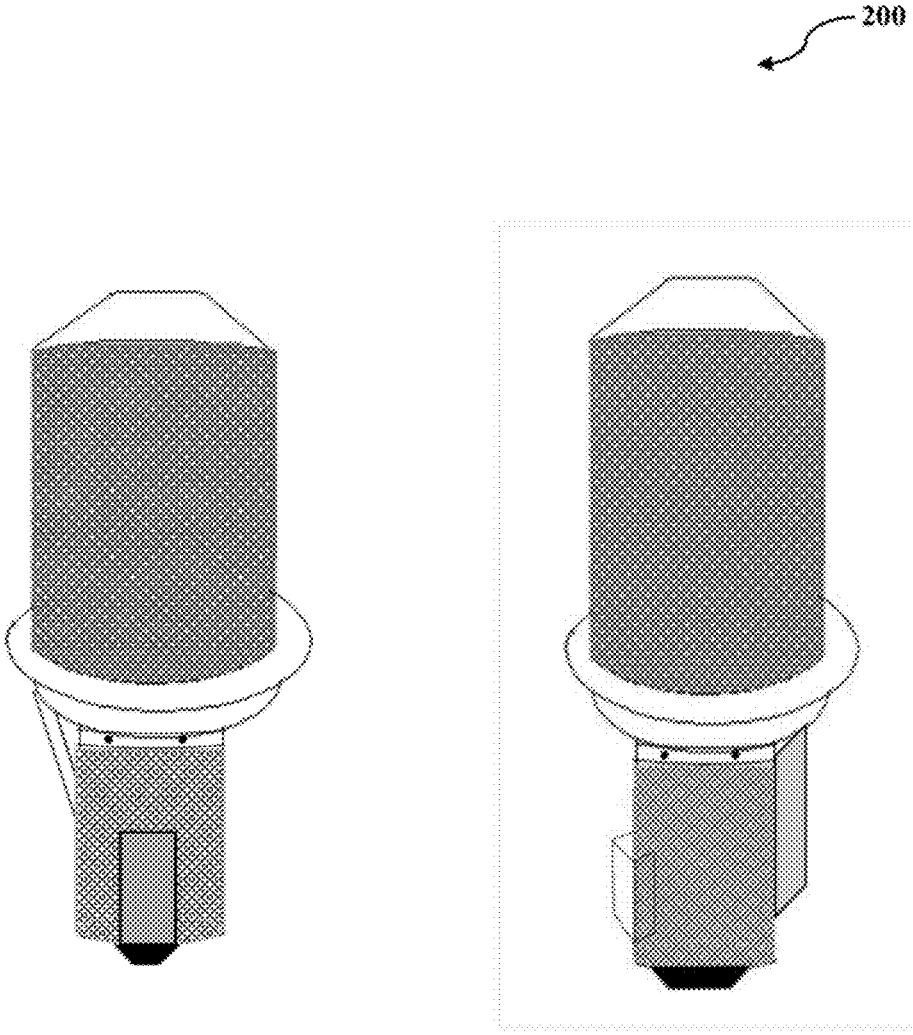
FIG. 2(*a*) and FIG. 2(*b*) illustrates the perspective view of the outdoor gas fired patio heater, in accordance with an embodiment of the invention.

FIG. 2(*a*) and FIG. 2(*b*) illustrates the perspective view of the outdoor gas fired patio heater, in accordance with an embodiment of the invention.

Figure 3:
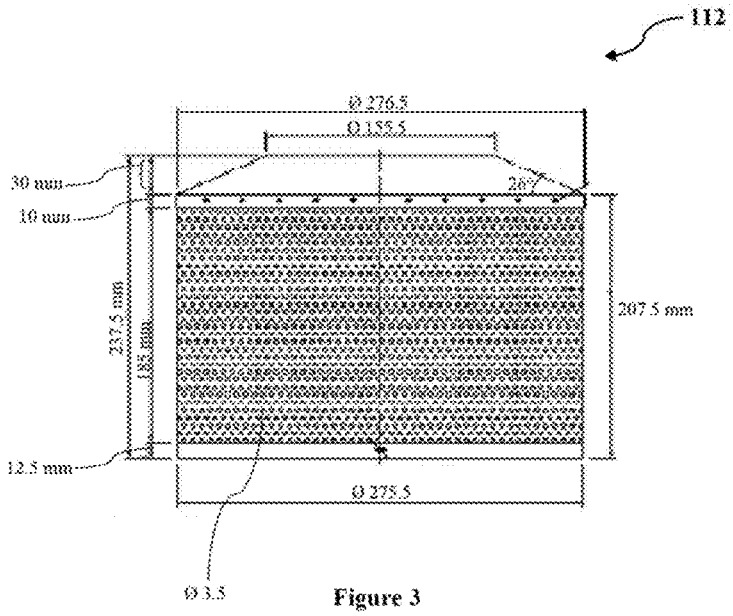
FIG. 3 illustrates the perspective view of an assembly PH emitter grid assembly, in accordance to one or more embodiments of the invention.

FIG. 3 illustrates the perspective view of the assembly PH emitter grid assembly, in accordance with an embodiment of the invention. An assembly PH emitter grid assembly 112 is fitted upon the PH pan head 110, which encloses the burner assembly 107. The radiated heat is directed from assembly PH emitter grid assembly 112 to the reflector 113 placed at the top the heater.

In the preferred embodiment, the reflector 113 is used to radiant the surrounding. The reflector 113 is made of high quality aluminium, wherein the aluminum of good quality helps to withstand the heat and divert the infrared waves to the ground.

In the preferred embodiment, the assembly PH emitter grid assembly 112 is made of heavy duty stainless steel. This grid is allowed to heat the surroundings efficiently and it is designed such that it prevents the wind flow.

Figure 4:
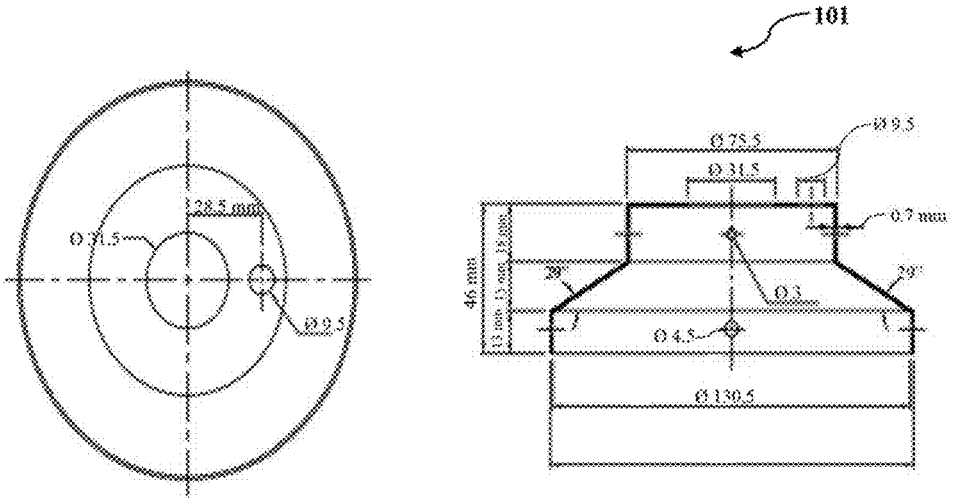
FIG. 4 illustrates the orthogonal front view of an assembly PH base, in accordance with an embodiment of the invention.

FIG. 4 illustrates the orthogonal front view of an assembly PH base, in accordance with an embodiment of the invention. The assembly PH base 101 is made of heavy duty stainless steel (SS 304). The gas inlet is connected to the base along with the gas valve.

Figure 5:
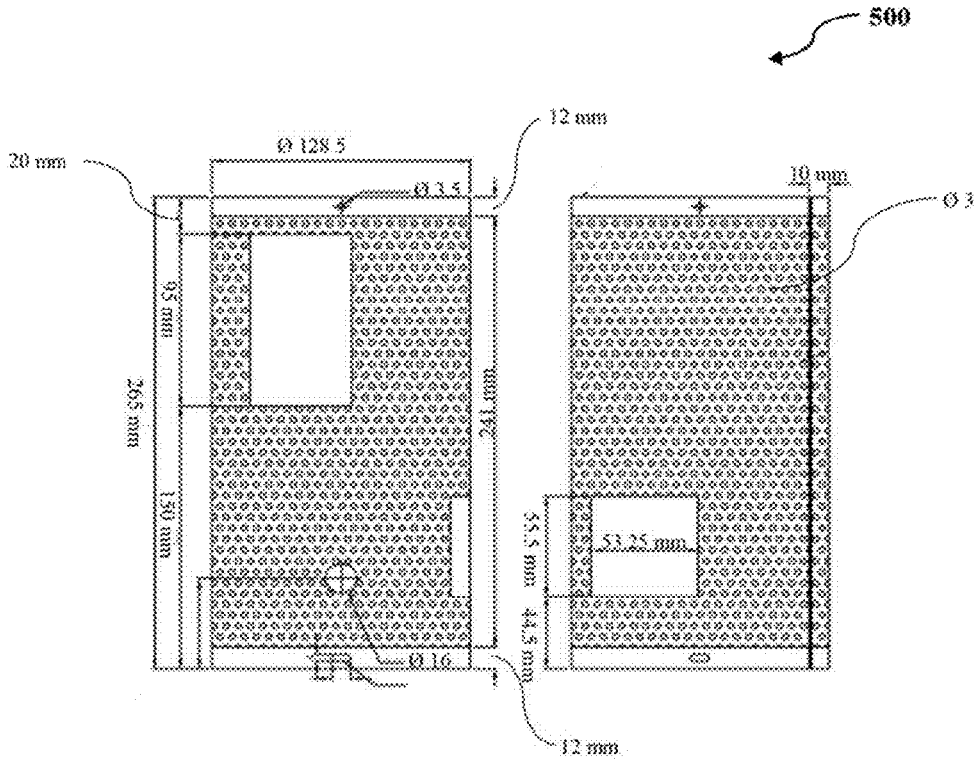
FIG. 5 illustrates the orthogonal view of a PH perforated cylinder, in accordance with an embodiment of the invention.

FIG. 5 illustrates the orthogonal view of the PH perforated cylinder, in accordance with an embodiment of the invention. The PH perforated cylinder 109 is made of heavy duty stainless steel, wherein the PH perforated cylinder 109 is used to mount the gas valve and gas lighter unit 120.

Figure 6:
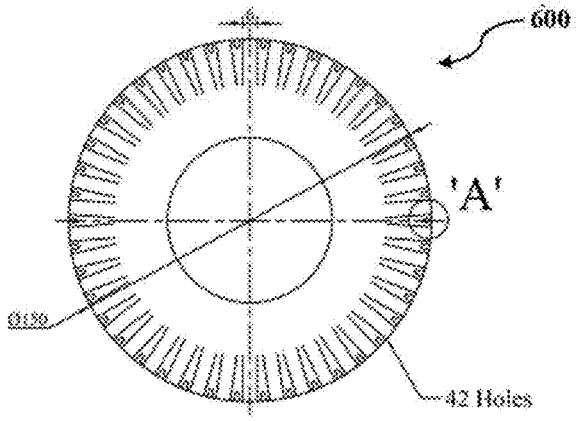
FIG. 6 illustrates the orthogonal top view of a burner top plate, in accordance with an embodiment of the invention.

FIG. 6 illustrates the orthogonal top view of a burner top plate, in accordance with an embodiment of the invention.

Figure 7:
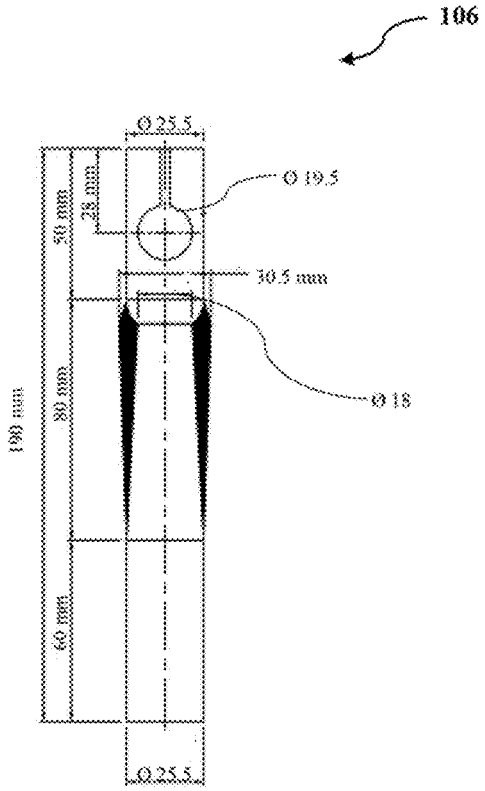
FIG. 7 illustrates the orthogonal view of the burner tube, in accordance with an embodiment of the invention.

FIG. 7 illustrates the orthogonal view of the burner tube 106, in accordance with an embodiment of the invention.

Figure 8:
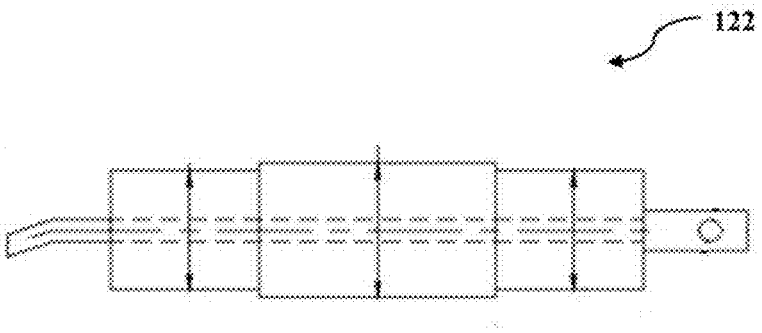
FIG. 8 illustrates the orthogonal view of the ignition electrode, in accordance with an embodiment of the invention.

FIG. 8 illustrates the orthogonal view of the ignition electrode, in accordance with an embodiment of the invention. The automatic spark is generated through ignition electrode 122 to ignite the heater within the predefined time.

Figure 9:
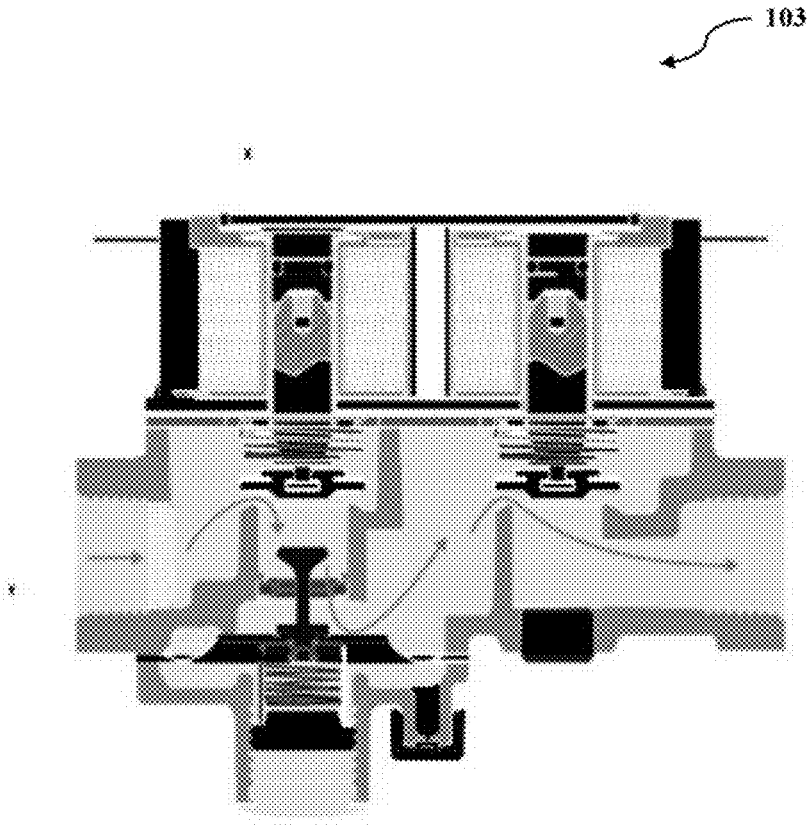
FIG. 9 illustrates the orthogonal front view of the gas combination valve, in accordance with an embodiment of the invention.

FIG. 9 illustrates the orthogonal front view of the gas combination valve 103, in accordance with an embodiment of the invention. The gas combination valve 103 controls the flow of gas entering from the gas supply. The rate of flow of gas is controlled by gas combination valve 103.

Figure 10:
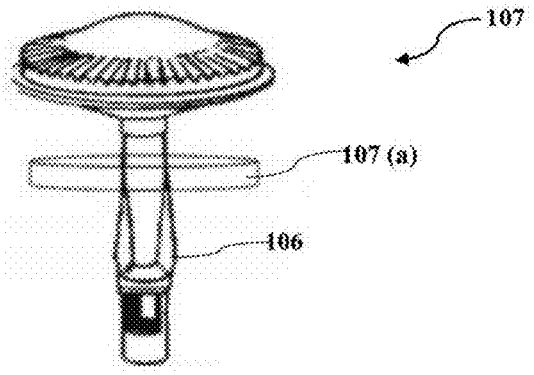
FIG. 10 illustrates the perspective view of the burner assembly, in accordance with an embodiment of the invention.

FIG. 10 illustrates the perspective view of the burner assembly 107, in accordance with an embodiment of the invention. The gas lighter unit 120 lights the burner, wherein the burner assembly 107 carries the flame and burns at all ports.

The burner assembly 107 is lighted without any delay, wherein the flames are not flashed back. During the process of extinguishing of flame in burner assembly 107, the extinction occurs without undo noise and without backpressure at the burner mixer face. Further, in the preferred embodiment, the burner is designed such that the flame is not affected with the air circulated in the environment, hence the burner fails to extinguish.

In the preferred embodiment, the burner assembly 107 is made of heavy duty stainless steel. It is designed in such a way that it will withstand the heat generated. The burner assembly 107 is supported on the burner tube 106 through a burner supported washer 107*a*.

Figure 11A:
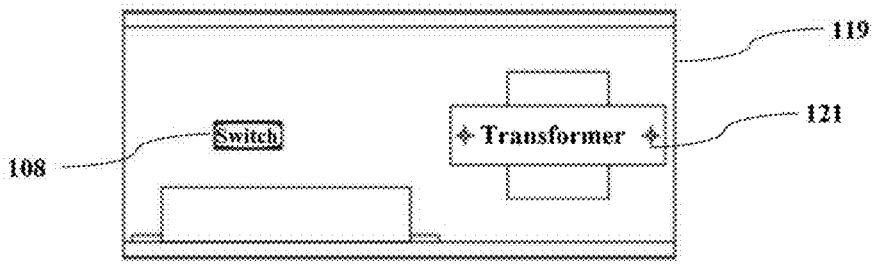
FIG. 11 (*a*) and FIG. 11 (*b*) illustrates the orthogonal front view of the enclosure box along with transformer, gas lighter unit and switch, in accordance with an embodiment of the invention.
Figure 11B:
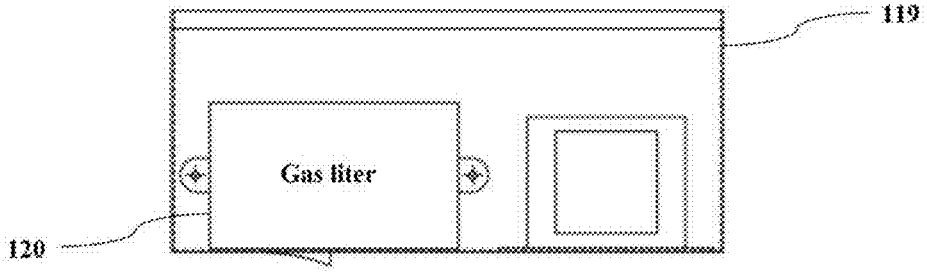

FIG. 11 (*a*) and FIG. 11 (*b*) illustrates the orthogonal front view of the enclosure box along with transformer, gas lighter unit and switch, in accordance with an embodiment of the invention. The transformer 121 steps down the voltage level from 120 volts to 24 volts. The transformer 121 is a Class II Wire Lead Multi-mount transformer which has half inch conduit hub for electrical knockout mounting. The ON/OFF switch 108 is also built in the appliance which is used as per the requirement.

The gas lighter 120 is designed to perform two operations, to control the gas valve and to power the pilot for ignition. A 24 volt is required to power up the gas lighter 120 which is fed from the transformer 121. This is designed in such a way that ignition will happen automatically. Even if the gas supply ceases, the spark will be re started fifteen times with the interval of 6 seconds between each spark. The transformer 121 used is inbuilt transformer that eliminates the need of external connections.

Figure 12:
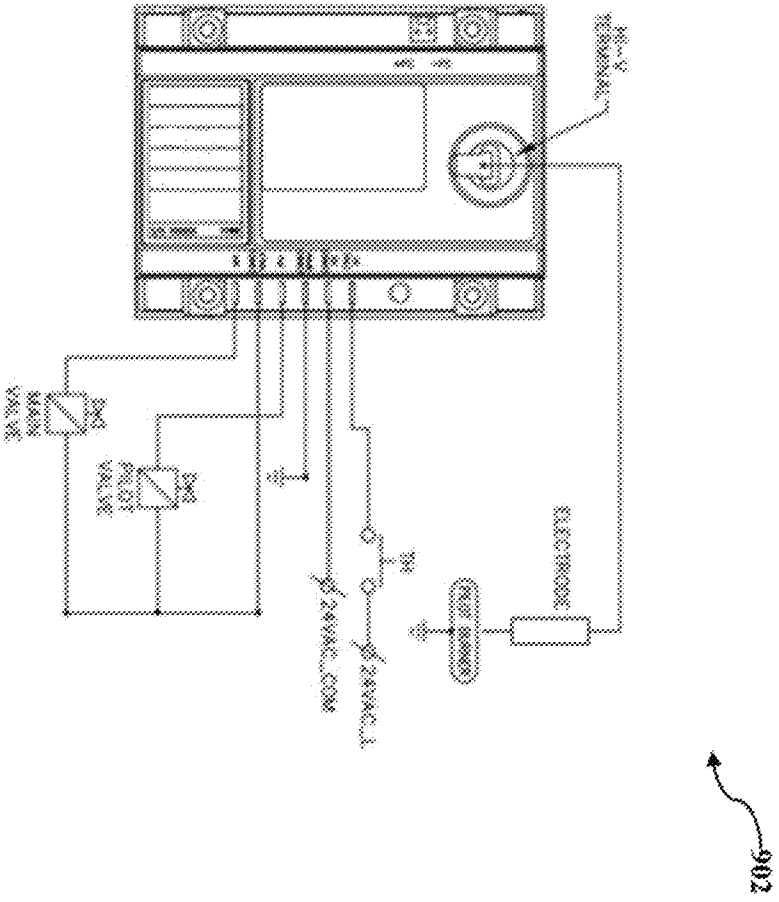
FIG. 12 illustrates the block diagram of the electronic control of gas lighter, in accordance with an embodiment of the invention.

FIG. 12 illustrates the block diagram of the electronic control of gas lighter, in accordance with an embodiment of the invention. The gas lighter 120 starts working once the switch 108 is turned ON and transformer 121 is powered. The number of trial is one, wherein the pre purge period is 3 seconds. The trial for ignition period is 90 seconds and the duty cycle to enable and disable the spark is 3 seconds. The sequence is repeated for 15 times. The main gas valve is opened, once the pilot is set with flame. Further the burner 107 starts igniting. In case the ignition fails after completing the trial for ignition period of 90 seconds and fails to light the pilot burner then the trial is again restarted within 5 minutes. The control enters lockout and then waits the recycle time before resetting and trying again.

The present invention provides an automatic ignition system to ignite the heater. Hence, the present invention is very easy to operate and user friendly. An inbuilt transformer is equipped within the heater, therefore an external connection is eliminated. The present invention is a plug and play unit ensuring the high standard safety measures.

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

We claim:

1. An outdoor gas fired patio heater, the heater comprises of:

a. a PH perforated cylinder (109) mounted on a PH base (101);

b. a tubing unit (115) along with a pilot assembly (116) fixed inside the PH perforated cylinder (109), wherein the tubing unit (115) and pilot assembly (116) are coupled with a pilot frame (117);

c. a PH pan head (110) placed on the top of the PH perforated cylinder (109), wherein the bottom of the PH pan head (110) has ventilation openings to allow the flow of combustion air;

d. a gas combination valve (103) fitted inside the PH perforated cylinder (109), wherein the gas combination valve (103) is covered with the perforated cylinder wall;

e. an enclose box (119) fitted on the outer side of the perforated cylinder wall, wherein the enclose box (119) comprises:

i. an ON/OFF switch (108);

ii. a gas liter unit (120), wherein the gas liter unit (120) is covered with the perforated cylinder wall, wherein the gas liter unit (120) comprises of a printed circuit board (PCB) control and a wire assembly;

iii. a transformer (121);

f. a burner assembly (107) fixed on the top of the PH perforated cylinder (109), wherein the burner assembly (107) is connected to the gas combination valve (103)

through a burner tube (106), an orifice (105) and an adapter (104) inside the PH perforated cylinder (109), wherein the burner tube (106), the orifice (105) and the adapter (104) are connected in series;

g. an PH emitter grid assembly (112) fitted upon the PH pan head (110), which encloses the burner assembly (107); and h. a reflector (113) mounted at the top of the PH emitter grid assembly (112).

2. The outdoor gas fired patio heater as claimed in claim 1, wherein said reflector (113) is dome shaped or mushroom shaped.

3. The outdoor gas fired patio heater as claimed in claim 1, wherein said transformer (121) is inbuilt transformer that eliminates the need of external connections.

4. The outdoor gas fired patio heater as claimed in claim 1, wherein said gas liter unit (120) starts working when the heater is powered ON, wherein an automatic spark is generated through ignition electrode (122) to ignite the heater within the predefined time.

5. The outdoor gas fired patio heater as claimed in claim 1, wherein said device regenerates the spark for the predefined number of times with the interval of predefined time between each spark during interruption of the gas supply, thereby the heater restarts automatically.

6. The outdoor gas fired patio heater as claimed in claim 5, wherein said device is switch OFF and restarted after certain period of time if the device fails to get ignited after automatic sparking for predefined number of times.

7. The outdoor gas fired patio heater as claimed in claim 5, further comprising a reducing bushing unit (102), the gas combination valve (103), the adapter (104), a name plate (114), a tubing unit (115), the pilot assembly (116), the pilot frame (117), ignition electrode (122), the inbuilt transformer (121), the enclose box (119), the gas liter unit (120), the ON/OFF switch (108), the burner assembly (107), a burner supported washer (107*a*) the PH perforated cylinder (109), the PH pan head (110), the PH emitter grid assembly (112), the reflector (113), the burner tube (106), the orifice (105), which is mounted on the PH base.

* * * * *